US005133542A

United States Patent [19]

von Kwiatkowski et al.

[11] Patent Number: 5,133,542

[45] Date of Patent: Jul. 28, 1992

[54] SHEET DELIVERY DEVICE FOR ROTARY CROSS CUTTERS

[75] Inventors: Kurt von Kwiatkowski, Bonn; Erich Gorissen, Leichlingen; Helmut Viertel, Düsseldorf, all of Fed. Rep. of Germany

[73] Assignee: Vits Maschinenbau GmbH, Langenfeld, Fed. Rep. of Germany

[21] Appl. No.: 540,344

[22] Filed: Jun. 19, 1990

[30] Foreign Application Priority Data

Jun. 21, 1989 [DE] Fed. Rep. of Germany ... 8907553[U]

[51] Int. Cl.[5] ..... B65H 29/68

[52] U.S. Cl. ..... 271/183; 271/197; 271/211

[58] Field of Search ..... 271/183, 194, 197, 202, 271/211

[56] References Cited

U.S. PATENT DOCUMENTS

| | | | |
|---|---|---|---|
| 3,178,174 | 4/1965 | Schneider | 271/183 |
| 3,224,761 | 12/1965 | Meyer-Jagenberg | 271/211 |
| 3,336,028 | 8/1967 | Schonmeier | 271/197 |
| 4,019,731 | 4/1977 | Vits | 271/183 |
| 4,221,377 | 9/1980 | Bodewein et al. | 271/183 |
| 4,405,125 | 9/1983 | Kulpa et al. | 271/211 |
| 4,799,847 | 1/1989 | Bodewein | 271/211 |
| 4,811,547 | 3/1989 | Raats et al. | 271/211 |
| 4,830,355 | 5/1989 | Jeschke | 271/183 |
| 4,886,263 | 12/1989 | Naito | 271/183 |
| 4,966,521 | 10/1990 | Frye et al. | 271/183 |

*Primary Examiner*—Robert P. Olszewski
*Assistant Examiner*—Steven M. Reiss
*Attorney, Agent, or Firm*—Marmorek, Guttman & Rubenstein

[57] ABSTRACT

The invention relates to a sheet delivery system for rotary cross cutters which has a stacking place and a suction brake table preceding the stacking place. Disposed preceding the suction brake table are drawing rollers which run at at least the conveying speed of the sheets arriving from the rotary cutter and which are disposed spaced out from one another on a driven shaft and between which deflecting rollers of smaller diameter are mounted for driven suction belts guided over the suction brake table. Provided in the gaps between the drawing rollers are blowing nozzles whose blowing direction is directed over the suction brake table.

3 Claims, 1 Drawing Sheet

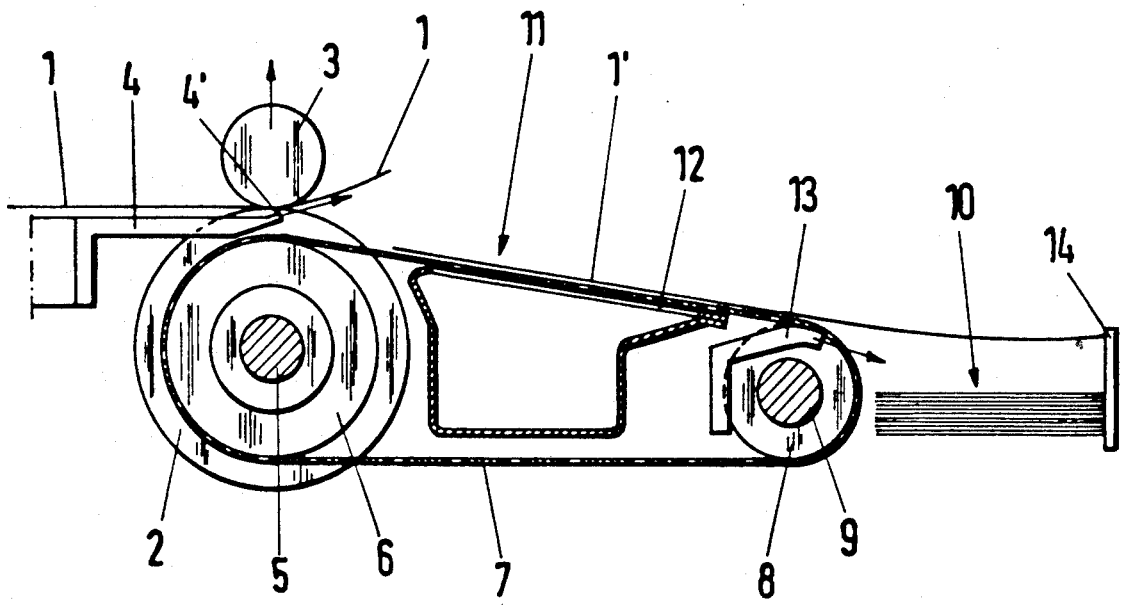
1
4
4'
3
1
11
1'
12
13
10
14
2
5
6
7
8
9

SHEET DELIVERY DEVICE FOR ROTARY CROSS CUTTERS

The invention relates to a sheet delivery system for rotary cross cutters which has a stacking place and a suction brake table preceding the stacking place.

In sheet delivery systems of the kind specified the sheet severed by the rotary cross cutter is normally first accelerated, to separate its rear edge from the front edge of the next sheet. To prevent the sheet conveyed to the stacking place from being impermissibly heavily stressed when it abuts an end stop, something which might lead to undulations or kinking, the sheet is decelerated to a non-critical speed by a suction brake table disposed preceding the stacking place and acting at least on the sheet rear edge. The following sheet is conveyed overlapping the decelerated sheet. In one prior art sheet delivery system the sheet end is forced by a mechanical depressor (a brush or the like), which is timed from the blade, on to a slowly rotating suction brake roller or the suction brake table. It is true that such sheet delivery systems operate satisfactorily, but they are expensive, due to the timing of the depressor and blade having regard to the distance covered by the sheet end at the machine speed. Unless harmonization is accurate, malfunctioning inevitably occurs.

It is an object of the invention to provide a simplified and reliably operating sheet delivery system for rotary cross cutters.

This problem is solved according to the invention in a sheet delivery system of the kind specified by the features that disposed preceding the suction brake table are drawing rollers which run at at least the conveying speed of the sheets arriving from the rotary cutter and which are disposed spaced out from one another on a driven shaft and between which deflecting rollers of smaller diameter are mounted for driven suction belts guided over the suction brake table, and provided in the gaps between the drawing rollers are blowing nozzles whose blowing direction is directed over the suction brake table.

In the sheet delivery system according to the invention there is no need to time individual functional members to the rotary cross cutter. The blowing nozzles disposed between the drawing rollers on the one hand lift the start of each sheet over the suction brake table, while at the same time forcing by the blown air the end of the leading sheet on to the suction brake table, so that the leading sheet is decelerated to a low speed non-critical for delivery.

According to one feature of the invention, the suction belts are guided over driven deflecting rollers which are disposed immediately preceding the stacking place and between which blowing nozzles are disposed whose blowing direction is directed to the stacking place. The blowing nozzles facilitate the guiding of the start of the sheet over the stack.

An embodiment of the invention will now be explained in greater detail with reference to the drawing.

Disposed between a cross cutter (not shown) and a forward drawing portion 2, 3 below the conveying plane of cut sheets 1 are battens with blowing nozzles 4. The forward drawing portion comprises drawing rollers 2 disposed spaced out non-rotatably on a driven shaft 5 and contact pressure rollers 3 cooperating with the drawing rollers 2. By their ends pointing in the conveying direction, the battens with the blowing nozzles 4 project between the drawing rollers 2, where they are constructed after the fashion of a ski-jump. At their ends they have blowing nozzles 4' the direction of whose jet is directed not on to, but over a suction brake table 11.

Disposed between the drawing rollers 2 are deflecting rollers 6 mounted free-wheeling for suction belts 7 taking the form of perforate belts. The suction belts 7 are driven by deflecting rollers 8 mounted non-rotatably on a drive shaft 9 immediately preceding the stacking place 10. Disposed below the top run of the suction belts 7 is a suction brake box 12 of the suction brake table 11 which ensures that negative pressure is exerted via the perforate suction belts 7 on a sheet 1' conveyed by the suction belts 7. Blowing nozzles 13 having a blowing direction directed towards the stacking place 10 are provided between the spaced-out driven deflecting rollers 8.

The sheet delivery system according to the invention operates as follows:

Sheets 1 arriving from a rotary cross cutter are conveyed at a predetermined conveying speed, which is as a rule higher than the speed of the web, as soon as they are seized by the forward drawing portion 2, 3. The start of the sheet is conveyed by the blown air of the battens constructed ski-jump fashion at the ends and having the blowing nozzles 4 over the suction brake table 11 and therefore also overlapping the sheet still seized by the suction brake table 11. However, the blown air also ensures that the end of the sheet is forced downwards against the suction brake table 11 when the sheet end has left the forward drawing portion 2, 3 and the start of the following sheet is conveyed thereover. The braking action of the suction brake table 11 decelerates the sheet 1' to a non-critical speed, so that the sheet is not damaged when it abuts a stop 14 at the stacking place 10.

We claim:

1. A sheet delivery system for rotary cross cutters which has a stacking place (10) and a suction brake table (11) preceding the stacking place (10), characterized in that disposed preceding the suction brake table (11) are drawing rollers (2) which run at at least the conveying speed of the sheets (1) arriving from the rotary cutter and which are disposed spaced out from one another on a driven shaft (5) and between which deflecting rollers (6) of a smaller diameter than the drawing rollers are mounted; said deflecting rollers guide driven suction belts (7) over the suction brake table (11), and provided in the gaps between the drawing rollers (2) and the deflecting rollers are blowing nozzles (4) whose blowing direction is directed over, and not on the suction brake table (11).

2. A sheet delivery system according to claim 1, characterized in that the suction belts (7) are also guided and driven by driven deflecting rollers (8) which are disposed immediately preceding the stacking place and between which blowing nozzles (13) are disposed whose blowing direction is directed towards the stacking place (10).

3. A sheet delivery system according to claim 1, characterized in that the deflecting rollers are mounted coaxially with the drawing rollers, on the given shaft.

* * * * *